US005881898A

United States Patent [19]

Irwin et al.

[11] Patent Number: 5,881,898

[45] **Date of Patent: *Mar. 16, 1999**

[54] OPEN TOP DRUM HAVING RIBBED CHIME

[75] Inventors: Patrick Irwin, Winchester; William C. Fields, Mt. Sterling, both of Ky.

[73] Assignee: Sonoco Products Company, Hartsville, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 584,410

[22] Filed: Jan. 11, 1996

[51] Int. Cl.[6] ..... B65D 25/00

[52] U.S. Cl. ..... 220/319; 220/640; 220/675

[58] Field of Search ..... 220/319, 649, 220/640, 320, 675

[56] References Cited

U.S. PATENT DOCUMENTS

| | | | |
|---|---|---|---|
| 1,826,947 | 10/1931 | Nelson . | |
| 1,849,312 | 3/1932 | Punte . | |
| 2,330,306 | 9/1943 | Murphy | 220/640 |
| 2,655,397 | 10/1953 | Augspurger et al. . | |
| 2,714,469 | 8/1955 | Carlson | 220/640 |
| 3,696,962 | 10/1972 | Fehres et al. . | |
| 4,177,934 | 12/1979 | Hammes et al. . | |
| 4,267,940 | 5/1981 | Wade . | |
| 4,500,010 | 2/1985 | Schütz . | |
| 4,674,648 | 6/1987 | Przytulla | 220/649 |
| 4,905,861 | 3/1990 | Boxall et al. | 220/640 |
| 5,018,642 | 5/1991 | Pyzytulla | 220/649 |
| 5,190,157 | 3/1993 | Przytulla . | |
| 5,193,715 | 3/1993 | Schultz | 220/649 |
| 5,301,853 | 4/1994 | Addison et al. . | |
| 5,427,264 | 6/1995 | Addison . | |

FOREIGN PATENT DOCUMENTS

| | | |
|---|---|---|
| 2 017 380 | 5/1970 | France . |
| 41 26 784 A1 | 2/1993 | Germany . |
| 94 14 955.0 | 12/1994 | Germany . |

OTHER PUBLICATIONS

International Search Report for PCT 97300108.4 dated Apr. 28, 1997 from Mewburn Ellis.

*Primary Examiner*—Joseph M. Moy
*Attorney, Agent, or Firm*—Alston & Bird LLP

[57] ABSTRACT

An open top drum having a closed bottom, a sidewall extending upwardly from said bottom, and a chime portion for receiving a removable cover. The chime portion extends from the sidewall so as to define an open top and includes a substantially radial first chime wall, a substantially cylindrical second chime wall directed upwardly from an outer portion of the first chime wall, and an exterior circumferential rib circumscribing a lower portion of the second chime wall for added rigidity. The drum assembly may also include a cover having a peripheral chime receiving member, and a retaining ring having a first leg for engaging the cover and a second leg for engaging the first chime wall. The legs are joined by an intermediate band. The cover may include a circumferential flange that extends over a portion of the second chime wall but not over the rib. The rib fills a substantial portion of an area defined by the second leg, intermediate band, second chime wall and circumferential flange.

7 Claims, 2 Drawing Sheets

OPEN TOP DRUM HAVING RIBBED CHIME

FIELD OF THE INVENTION

The invention relates to open top drums having removable covers, and in particular, to plastic open top drums having a chime, a cover that fits over the chime, and a retaining ring that engages the cover and chime to secure the cover to the drum. The chime, ring and cover resist separation due to impact when a loaded drum is dropped.

BACKGROUND OF THE INVENTION

Various liquids and solids, including hazardous liquid and solid materials, are often stored and transported in drums. Such drums are commonly made of plastic, steel or fiber. Drums are typically either of tight head or open head construction; however, open top drums are becoming increasingly popular for shipping both hazardous and non-hazardous materials, largely because they are easy to handle, versatile, and may, in some cases, be nested when empty, thus saving significant storage and shipping space.

In recent years, open top drums made of blow molded or injection molded plastic have come into increasingly frequent use. Plastic open top drums offer the added benefits of being inexpensive, durable and reusable in many applications. Also, plastic drums are nonreactive with a wide variety of contents and are useful for waste disposal applications because they may be loaded with waste material and incinerated easily, with a minimum of energy being required to heat and incinerate the plastic material.

Plastic open top drums and plastic covers therefor are commonly constructed of any of a variety of plastic materials, including but not limited to polyolefins, styrenes, polyethelyne terethalate (PET), polyvinylchloride (PVC), polycarbonate, ABS, nylon polyphenylenes, polyacetals, polyesters and other resins or materials that have adequate Theological properties for blow molding or injection molding and which may be chosen based on the intended use of the drum.

Large size plastic open top drums, e.g., those having capacities in the range of about 30 gallons to about 55 gallons or even greater, were initially developed for the food industry. Later, when applications involving hazardous materials became important, maintaining the integrity of the seal of the drum and cover became of much greater importance than had previously been necessary with respect to drums intended for food applications, as it was necessary to prevent leakage or discharge of hazardous materials during handling and shipment. Accordingly, the United States Department of Transportation ("DOT") developed testing and certification procedures, and promulgated regulations embodying these test and certification requirements, that are applicable to drums for use in transporting hazardous materials.

The test procedures and regulations of the DOT are currently based on the United Nations Recommendations of the Committee of Experts on the Transport of Dangerous Goods. They require, in part, that the drums be subjected to "drop tests" from various heights to insure that the contents of the drum are not ejected when the drum is dropped on its weakest point. Typically, this requires that the plastic drum be dropped from a height of between about two, four and six feet, depending on the type of hazardous material that is to be carried in the drum. The drum is typically dropped in an inverted diagonal orientation so that the impact takes place on the interface between the retaining ring, cover and chime of the drum assembly. Also, the drum is loaded with a desired amount of heavy test material before it is dropped. Whether or not the drum passes the test is determined by whether the contents of the drum are discharged by the impact.

A typical drop test in accordance with the United Nations/DOT specifications is illustrated in FIGS. 2A and 2B. In FIG. 2A, the drum assembly P, which includes a drum body with a cover and retaining ring affixed thereto and which is loaded with a desired weight W, is shown in a first elevated position during an initial portion of a drop test, after the drum has been released and is in free fall prior to impact. FIG. 2B shows the drum assembly P at the point of impact during the drop test, which illustrates an exemplary deformation of the sidewall of the drum body, the retaining ring, and cover when the drum assembly P strikes a floor surface F.

In general, a drum that is intended for use with extremely hazardous materials must retain its contents in a drop test that is conducted from a greater height than is required for drums to be certified for use with less hazardous materials. For example, the most challenging drop test that is prescribed by the DOT/UN regulations is for hazardous materials in the "X" classification, which require that the drum pass a drop test from a height of about six feet. The "Y" classification, which pertains to less hazardous materials, requires passing a drop test conducted from a height of about 4 feet. The still less hazardous "Z" classification requires that the drum pass a drop test from a height of about two feet. The DOT/UN drop testing must be performed after the drum and its contents have been cooled to a temperature of 0° Fahrenheit or less. If a sufficient number of the drums pass the test at the desired impact, then the drums may be certified for carrying a specified weight of the relevant X, Y or Z classification materials. As a general rule it is desirable to maximize the weight of the contents that a drum is certified to contain during transportation.

In addition, the National Motor Freight Council ("NMFC"), which governs the shipment of nonhazardous material by road, and the Uniform Freight Council ("UFC"), which governs shipment of nonhazardous materials by rail, require that open top plastic drums pass a "tip over" test. In this test a drum is filled with water, the cover and retaining ring are secured to the drum, and the drum assembly is tipped over onto a hard surface such as concrete. The drum passes the test if it does not leak its contents as a result of the impact suffered when the drum is tipped over.

FIG. 3 is a sectional side elevation view of the chime portion 20, cover 12 and retaining ring 13 of one drum assembly 10 that is known in the prior art. Typically, the drum body sidewall 14 is topped off by a chime portion 20. The chime portion 20 includes a first chime wall 21 and a substantially vertical second chime wall 22. The first chime wall 21 may extend upwardly and outwardly from the sidewall 14, often at an angle of between about 15° and 30°; however, in recent structures, the first wall 21 extends substantially radially from the axis of the drum 10. It has been found that a substantially radial wall 21 provides improved retention of the retaining ring 13. The cover 12 of the prior art assembly 10 typically includes a peripheral chime engaging structure 23 which is bounded by an external flange 24. The external flange 24 is typically sized so as to fit over and around an upper portion of the second chime wall 22. The peripheral chime engaging portion 23 and first chime wall 21 are typically secured to one another by first and second legs 25 and 26, respectively, of the retaining ring 13. The retaining ring may include an intermediate wall 30 interconnecting the legs 25 and 26; alternatively, the legs 25 and 26 may be connected by a curved wall or other structure. The ring 13 may be made of metal or any of a variety of plastic materials. The bottom leg 26 is sometimes formed so that when the ring 13 is installed on the drum assembly 10, the leg 26 extends in a substantially radially orientation relative to the axis of the drum 10, although various angled configurations may be used.

Also as shown in FIG. 3, the prior art structure typically includes a gasket 31; however, covers 12 are sometimes provided without a gasket. The cover 12 may also include a central disk portion 32 and a dependent skirt 33, which may be reinforced by a plurality of radial ribs 34.

As illustrated in FIG. 3, the construction of many prior art drum assemblies 10 has resulted in a void area 35 near a lower portion 36 of the second chime wall 22 such that the void area 35 circumscribes the exterior periphery of the wall 22 beneath the intermediate band 30 of the ring 13. It has been found that the presence of this void area 35 may permit the ring 13, and in particular, the lower leg 26 thereof, to shift when the ring 13, cover 12 and chime portion 20 of the drum body 11 are deformed by an impact as illustrated in FIG. 2B.

Previous open top plastic drum, cover and retaining ring structures of the type illustrated in FIG. 3, as well as others, have passed the drop and tip over tests at certain loading weights. However, the weights at which such drums have passed these tests are limited. As it is desirable to maximize the certification conditions at which a drum may be used to transport materials under the applicable regulations, it is desirable to increase the weight that a drums will retain while passing the drop and tip over tests.

In accordance with the foregoing, one object of the present invention is to provide an open top drum chime, having an improved chime structure so that the drum cover and receiving ring assembly will remain intact during the drop and tip over tests at increased loading weights so as to attain higher DOT/UN and NMFC/UFC certifications.

Another object of the invention is to provide a drum assembly which has improved drop test performance without significantly increasing the cost of producing the drum assembly, either by increased material usage or the need for extensive new tooling.

Another object of the invention is to provide a blow molded open top drum assembly having improved drop test characteristics that may be produced without significantly increased production cycle times or undesirable deformation of the sidewall of the drum body while the plastic material is cooled following the blow molding operation.

Yet another object of the invention is to provide a plastic drum assembly that has improved drop test characteristics but which does not have significantly increased mass which might increase the thermal energy that would be required to incinerate the drum.

A further object of the present invention is to provide a blow molded open top plastic drum having improved cover retention characteristics which may be produced with only nominal modification of existing molding equipment.

A still further object of the present invention is to provide a means for stiffening the chime portion of an open top plastic drum without the use of compression molding techniques.

A further object of the present invention is to provide a drum assembly in which void areas between the cover, retaining ring and drum chime are substantially filled so as to prevent shifting of the retaining ring and cover when the drum assembly is drop tested or otherwise subjected to impact.

Yet another object of the present invention is to provide an open top drum having improved cover retention characteristics which may be handled with existing parrot beak type equipment.

SUMMARY OF THE INVENTION

The above and other objects and advantages of the present invention are achieved in the embodiment described herein by the provision of an open top drum having a closed bottom, a substantially axially symmetrical sidewall extending upwardly from said bottom, and a chime portion for receiving a removable cover. The chime portion extends from the sidewall so as to define an open top and includes a substantially radial first chime wall that projects outwardly from the sidewall, a substantially cylindrical second chime wall directed upwardly from an outer portion of the first chime wall and having a lower portion adjacent said first chime wall, and an exterior circumferential rib circumscribing the lower portion of the second chime wall. The rib increases the rigidity of the chime portion.

The drum assembly may also include a cover having a peripheral chime receiving member and a retaining ring having a first leg for engaging the peripheral chime receiving member, a second leg for engaging the first chime wall, and an intermediate band connecting the first and second legs. The peripheral chime receiving member may include a circumferential flange having a diameter larger than the second chime wall so as to extend over a portion of the second chime wall. Preferably, the circumferential flange does not extend over the rib of the drum body. The rib may be oriented and may have a size so that it fills a portion of an area defined by the second leg and intermediate band of the retaining ring, the second chime wall of the drum body and the circumferential flange of the cover. In one embodiment, the rib substantially fills this area, may have a bottom face that is substantially coplanar with the first chime wall, and may be about 0.10 in. high (as measured from the outer face of the second chime wall) and about 0.15 in. wide, with radiused corners. Ideally, the second leg of the retaining ring engages the bottom face of the rib, as well as the first chime wall, so as to further secure the ring and cover to the drum body. The rib may be either continuous or discontinuous.

The drum may be made of blow molded plastic, and the sidewall of the drum may be substantially cylindrical, substantially frustroconical, or may be of some other shape. The drum body may further include rolling hoops and/or enlarged bumper sections for protecting the retaining ring and chime portions during handling of the drums, as well as various other configurations that may be shapes defined by rotation about a central axis, or other shapes that may not be axially symmetrical. The cover may be made of plastic of some other suitable material and may include a skirt that extends inside the chime portion of the drum body. Further, the ring, cover and chime may be adapted for handling by parrot beak mechanisms of the type commonly known in the art.

BRIEF DESCRIPTION OF THE DRAWINGS

The foregoing and other objects, advantages and features of the invention, and the manner in which the same are accomplished, will become apparent from the following detailed description of the invention taken in conjunction with the accompanying drawings which illustrate a preferred and exemplary embodiment, wherein.

DESCRIPTION OF A PREFERRED EMBODIMENT

Figure 1:
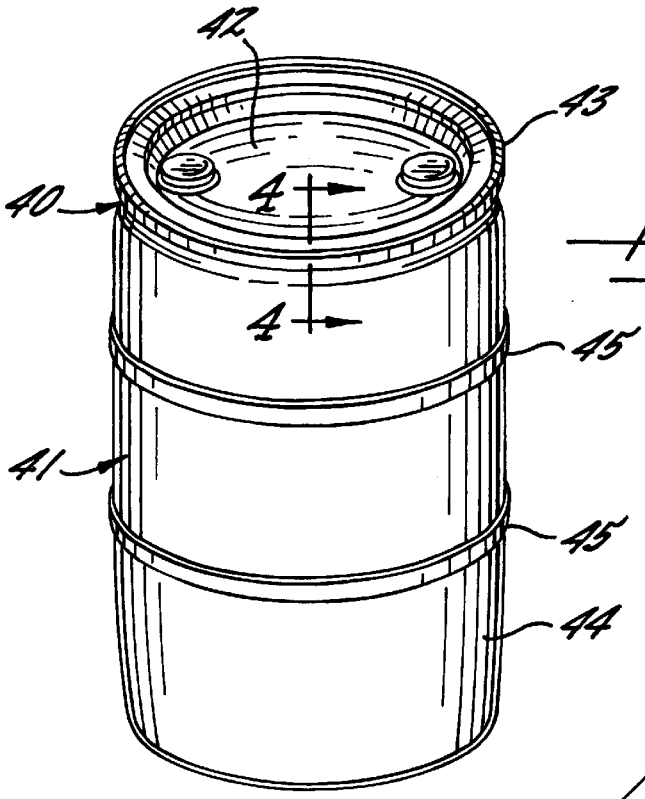
FIG. 1 is a perspective view of an open top drum, with retaining ring and cover installed thereon, made in accordance with the principles of the present invention.

Referring now to the drawings, FIG. 1 is a perspective view of one embodiment of a new open top drum assembly made in accordance with the present invention, indicated generally at 40. The assembly 40 includes a drum body 41, a cover 42 and a retaining ring 43. In the embodiment illustrated in FIG. 1, the drum 41 includes a closed bottom (not shown) and a may include a plurality of rolling hoops 45 or similar structure such as enlarged bumpers for protecting the retaining ring 43 and cover 42 during handling of the drum assembly 40. Alternatively, the sidewall 44 may be frustroconical in shape, or may include a combination of frustroconical and cylindrical portions, or other shapes typically rotated about a central axis, although non-radially symmetric shapes may be used. The sidewall 44 may be tapered or radiused near the closed bottom of the drum.

Figure 4:
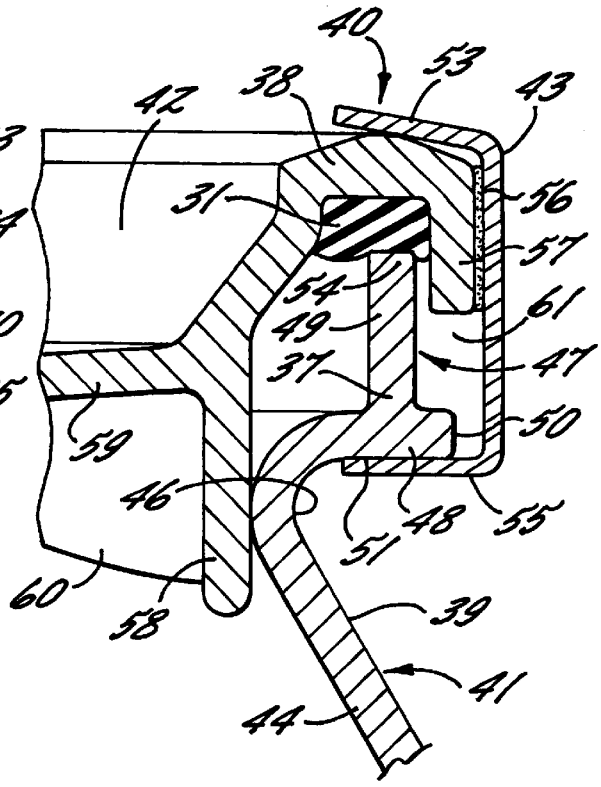
FIG. 4 is an enlarged, partial cross-sectional view taken along line 4—4 of FIG. 1.

FIG. 4 further illustrates a portion of one preferred embodiment of a drum assembly 40 made in accordance with the present invention. As illustrated therein, the sidewall 44 of the drum body 41 includes an inclined portion 39 leading to a radiused interconnection region 46 and a chime portion 47. The chime portion 47 includes a first chime wall 48 that is preferably substantially radial with respect to the axis of the drum 40; however, the wall 48 may be inclined. The chime portion 47 may also include a second chime wall 49 that may be in a generally cylindrical orientation about the drum axis, so that the second chime wall 49 extends generally upwardly from an outer portion of the first chime wall 48.

A rib 50 may extend from a lower portion 37 of the second chime wall 49. The rib 50 may be formed in either a continuous or discontinuous fashion around the periphery of the drum body 41. In the embodiment illustrated, the rib 50 extends continuously around the periphery of the drum body 41. Also in the illustrated embodiment, the bottom face 51 of the rib 50 is substantially coplanar with the bottom face 52 of the first chime wall 48. The rib 50 may have a substantially rectangular cross section, although other shapes may be used; also, the rib 50 may be provided with radiused corners.

The cover 42 is fitted over the chime portion 47 and is retained thereto by a peripheral chime receiving member 38 and a retaining ring 43. The ring 43 includes a first leg 53 for retaining the peripheral chime engaging member 38 the cover 42. The first leg 53 may be formed in an angled cross sectional orientation, as shown in FIG. 4, so as to provide a downward force on the cover 42 as the retaining ring is tightened about the drum chime portion 47 and cover 42. The cover 42 may also have a gasket 31 that rests upon an upper portion 54 of the second chime wall 49. The first leg 53 of the retaining ring 43 engages the top of the peripheral chime engaging structure 38 of the cover 42, and a second leg 55 of the ring 43 is provided to engage the first chime wall 48 and preferably, the bottom face 51 of the rib 50. The first and second legs 53 and 55 of the ring 43 may be interconnected by an intermediate band 56, which may be cylindrical in shape as shown in FIG. 4, or which may have an arcuate or other shape. The ring 43 may be metal, plastic or any other suitable material.

A circumferential flange 57 on the cover 42 extends over the upper portion 54 of the second chime wall 49 so as to cover a portion of the outside surface of the wall 49. However, the length of the flange 57 is short enough that the flange covers an upper portion of the second chime wall 49 but not the lower portion 37 of the second chime wall or the rib 50.

Figure 2A:
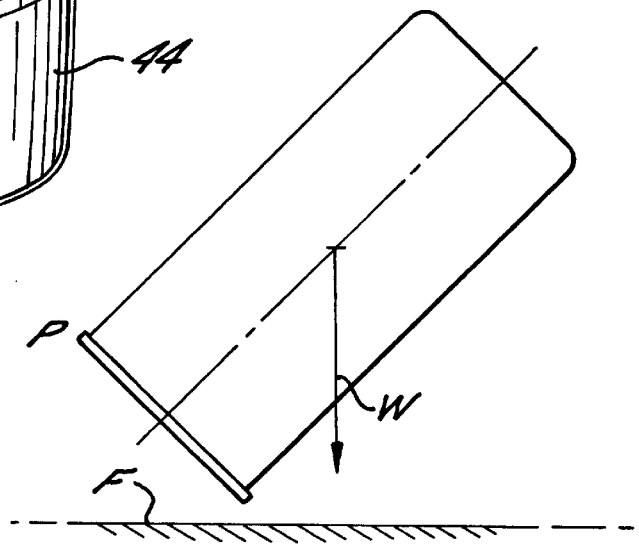
FIG. 2A is a side elevation view illustrating an open top plastic drum with cover and retaining ring fixed thereto in a substantially inverted diagonal position of the type frequently used in drop testing under the applicable regulatory certification requirements.
Figure 2B:
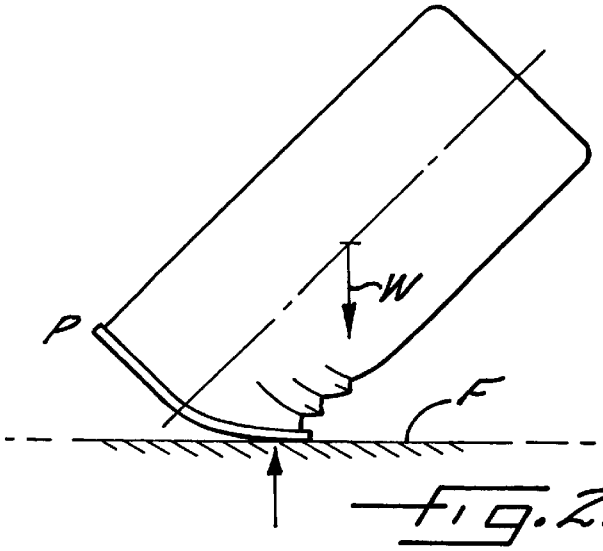
FIG. 2B is a further side elevation of the drum illustrated in FIG. 2A which shows a typical deformation of the drum when the cover, retaining ring and drum opening impact a fixed surface, such as during drop testing.

The protrusion of the rib 50 from the second chime wall 49 fills a substantial portion of the void area that would otherwise be present between the intermediate band 56 of the ring 43 and the second chime wall 49, and between the second leg 55 and the bottom of the circumferential flange 57. Further, the rib 50 increases the length of the engagement of the lower leg 55 of the ring 43 with the chime portion 47. The rib 50 is also believed to increase the moment of inertia of the chime portion 47 so as to provide greater stiffness when the drum assembly 40 is dropped, as illustrated in FIGS. 2A and 2B. Furthermore, since the rib 50 increases the length of engagement of the drum chime 47 on the lower leg 55 of the ring 43, the ring 43 can withstand further deformation before sliding off of the drum chime 47.

The cover illustrated in FIG. 4 includes an inner skirt 58 and central disk 59, with interspaced radial reinforcing ribs 60. However, other types of covers may be used without departing from the spirit of this invention. For example, plastic or steel covers known commonly in the art as "fiber" drum covers may be used in conjunction with the new chime portion 47 described herein.

It has been found that this configuration provides enhanced drop test performance but that the amount of material required to form the rib is sufficiently small so that the cooling rate of the chime portion following the blow molding operation is not materially affected, thus preventing undesired disparities in the cooling and shrinkage rates at various points of the chime which might cause deformation in the resultant drum product. It has also been found that filling the area between the retaining ring legs adjacent the intermediate ring wall results in a more secure engagement between the ring, cover and drum so that the ring is less likely to shift when the drum, cover and ring are subjected to impact.

Figure 3:
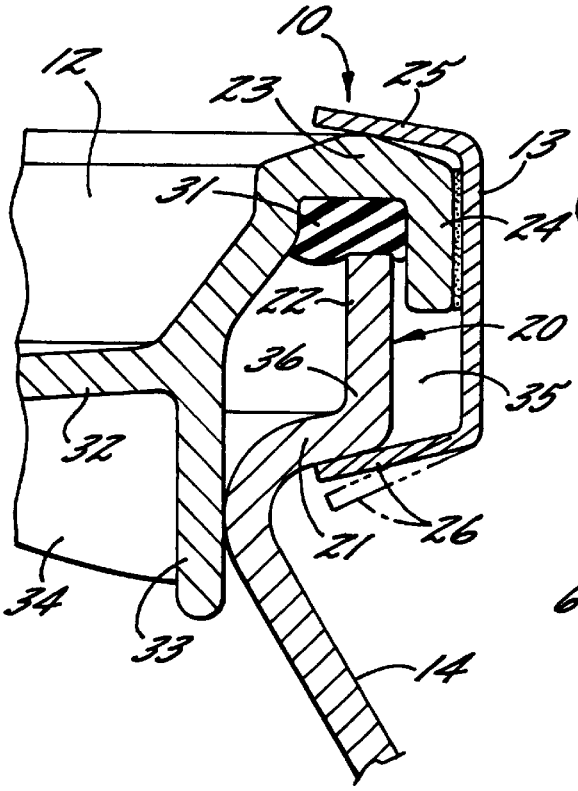
Fig. 3. (PRIOR ART)
FIG. 3 is an enlarged cross-sectional view of a chime portion, retaining ring and cover of one known type of drum assembly.

Results of testing using the new chime having a rib extending from a lower portion of the second chime wall 49 have yielded surprising results. Provision of a rib 50 having a height of 0.100 inches, a width of 0.150 inches, and edges having radii of about 0.062 inches, has been found to increase the weight of the product that may be contained in open top plastic drums with covers, without bursting, by between 29% and 295%. In each instance, the only change from a drum body, lockband and cover that had been used in the prior art (in some instances, similar to that illustrated generally in FIG. 3), was the addition of the rib 50. The results of this testing are summarized below:

| Drum Model | Retaining Ring | Cover | Prior Performance | New Performance | Improvement |
|---|---|---|---|---|---|
| O14 | 18 Ga. gal. | L14 | Y37 | Y146 | 295% |
| O15 | 18 Ga. gal. | L14 | Y56 | Y156 | 179% |
| O30 | 18 Ga. gal. | L30hp | Y85 | Y150 | 76% |
| O40MB | 16 Ga. gal. | FDS | Y150 | Y200 | 54% |
| O47MB | 16 Ga. gal. | FDS | Y140 | Y200 | 43% |
| O55BT | 16 Ga. gal. | L45 | Y140 | Y180 | 29% |
| OL55 | 16 Ga. epoxy | FDS | Y140 | Y250 | 92% |

The "model" references above concern product nomenclature used by Sonoco Products Company, Industrial Container Division, Lombard, Ill. The numerical portions of the model references indicate the capacity, in gallons, of the drum. Covers bearing "L" designations have a structure similar to the cover 42 shown in FIG. 4, whereas the "FDS" covers are of the type commonly referred to as plastic fiber drum covers. The performance data is provided in accordance with United Nations' standards for classification "Y" materials, which require drop testing from a height of approximately 4 feet. The numerical portion of the performance figures indicate the weight, in kilograms, of the contents of the drum, cover and retaining ring combination during the drop test.

In open top drums that are manufactured by blow molding, it is preferable that the rib 50 be formed in dimensions that are sufficiently small to prevent the formation of a recessed area on the inside of the chime portion 20. This is particularly of interest when the rib 50 is elevated above the first chime wall 48. It is particularly desirable to avoid formation of a concave recessed area so as to prevent a portion of the contents of the drum from being captured in the concave area if the drum is opened and emptied by tipping. Furthermore, the size of the rib 50 is important in the manufacture of the drums 41 by blow molding, as introduction of an excessive thickness of material at the rib 50 may lead to deformation of the chime portion 47 when the hot blow molded material has been shaped and is left to cool, as excessive localized plastic material may lead to "hot spots" that may result in uneven cooling and deformation of the resultant product. However, it is desirable that the rib 50 be shaped so as to occupy as much of the void area 61 as possible, although it has been found that improved drop test results will be obtained even if the rib 50 occupies only a portion of the void area, particularly if the rib 50 is defined at a lower portion of the second chime wall 49 so that its bottom face is engaged by the second leg 55 of the retaining ring 43.

The specifications and configuration of the rib 50 may vary depending, in part, on the size/capacity of the drum body, the type of resin used to further the drum body, the system used to regulate wall thickness during blow molding, and the configuration of the cover and retaining ring.

A further advantage of the present invention is that existing blow molding tooling for producing open top plastic drums from plastic materials may be used with only inexpensive and nominal modification for producing the new invention. It has been found desirable merely to cut a groove in the appropriate portion of the blow molding tooling near the chime forming area in order to form the rib 50, and to use such tooling in a conventional manner so as to produce drum bodies in accordance with the present invention.

In the drawings and specification, there has been disclosed a typical preferred embodiment of the invention. Although specific terms have been employed, they have been used in a generic and descriptive sense only and not for purposes of limitation, the scope of the invention being set forth in the following claims.

That which is claimed is:

1. An open top plastic drum, comprising:

a blow-molded drum body having:

a closed bottom, a substantially axially symmetrical sidewall extending upwardly from said bottom, and a chime portion for receiving a removable cover, said chime portion extending from said sidewall so as to define an open top and including:

a substantially radial first chime wall projecting outwardly from said sidewall and having a bottom surface, a substantially cylindrical second chime wall directed upwardly from an outer portion of said first chime wall and having a lower portion contiguous with adjacent said first chime wall, said second chime wall having a thickness substantially the same as the thickness of said side wall, and an exterior circumferential rib having a bottom surface that is substantially coplanar with said first wall and substantially perpendicular to the longitudinal axis of the container circumscribing said lower portion of said second chime wall, whereby said rib increases the moment of inertia of the chime portion and thus provides greater rigidity to said chime portion;

a cover having a peripheral chime receiving member that includes a circumferential flange having a inner diameter larger than said second chime wall but less than said circumferential rib, so as to extend only over an upper portion of said second chime wall but not over said rib;

a retaining ring having first and second legs fixedly connected by an intermediate band, wherein said first leg engages an outer surface of said peripheral chime receiving member directly above said second chime wall and wherein said second leg engages the bottom portions of said rib and said first chime wall directly below said second chime wall such that the length of engagement of the lower leg of the ring with the chime portion is increased and the ring has increased resistance to deformation and sliding from the chime if the drum is dropped.

2. An open top drum as defined in claim 1 wherein said rib fills a portion of an area between said second leg, intermediate band, second chime wall and circumferential flange.

3. An open top drum as defined in claim 2 wherein said rib substantially fills said area.

4. An open top drum as described in claim 3 wherein said rib is about 0.10 in. high and about 0.015 in. wide.

5. An open top drum as defined in claim 1 wherein said drum is made of blow molded plastic and said sidewall in substantially cylindrical.

6. An open top drum as defined in claim 1 wherein said drum is made of blow molded plastic and said sidewall is substantially frustroconical.

7. An open top drum as described in claim 1, wherein said cover is plastic and includes a skirt that extends inside said chime portion.

* * * * *

UNITED STATES PATENT AND TRADEMARK OFFICE

CERTIFICATE OF CORRECTION

PATENT NO. : 5,881,898

DATED : March 16, 1999

INVENTOR(S) : Irwin et al.

It is certified that error appears in the above-identified patent and that said Letters Patent is hereby corrected as shown below:

Column 8, line 59, "in" should read --is--.

Signed and Sealed this

Seventh Day of September, 1999

*Attest:*

Q. TODD DICKINSON

*Attesting Officer*

*Acting Commissioner of Patents and Trademarks*